US006953261B1

(12) United States Patent
Jiao et al.

(10) Patent No.: US 6,953,261 B1
(45) Date of Patent: Oct. 11, 2005

(54) REFLECTOR APPARATUS FOR A TUBULAR LIGHT SOURCE

(75) Inventors: Jianzhong Jiao, Novi, MI (US); Matthew A. Lekson, Northville, MI (US)

(73) Assignee: North American Lighting, Inc., Farmington Hills, MI (US)

( * ) Notice: Subject to any disclaimer, the term of this patent is extended or adjusted under 35 U.S.C. 154(b) by 0 days.

(21) Appl. No.: 09/513,040

(22) Filed: Feb. 25, 2000

(51) Int. Cl.[7] ..... F21V 4/00

(52) U.S. Cl. ..... 362/217; 362/223; 362/297; 362/341

(58) Field of Search ..... 362/297, 396, 362/341, 347, 217, 223, 304

(56) References Cited

U.S. PATENT DOCUMENTS 4,218,727 A * 8/1980 Shemitz et al. ..... 362/297
4,412,276 A * 10/1983 Blinow ..... 362/278
4,447,865 A * 5/1984 VanHorn et al. ..... 362/305
4,460,942 A * 7/1984 Pizzuti et al. ..... 362/217
4,494,176 A * 1/1985 Sands et al. ..... 362/297
4,506,316 A * 3/1985 Thiry et al. ..... 362/309
4,683,525 A * 7/1987 Camm ..... 362/346
4,730,240 A * 3/1988 van Meel et al. ..... 362/346
5,055,976 A * 10/1991 Arai ..... 362/17
5,136,491 A * 8/1992 Kano ..... 362/346
5,195,814 A * 3/1993 Hasushita et al. ..... 362/18
5,199,787 A * 4/1993 King et al. ..... 362/310
5,479,328 A * 12/1995 Lee et al. ..... 362/216
5,584,572 A * 12/1996 Ishikawa ..... 362/346
5,641,218 A * 6/1997 Sakurai ..... 362/16
5,735,595 A * 4/1998 Nederpel et al. ..... 362/223
5,975,723 A * 11/1999 Daumueller et al. ..... 362/297
6,155,694 A * 12/2000 Lyons et al. ..... 362/228
6,168,293 B1 * 1/2001 Lieszkovszky et al. ..... 362/297
6,461,023 B1 * 10/2002 McLoughlin et al. ..... 362/297
6,467,931 B2 * 10/2002 Tenmyo ..... 362/223

* cited by examiner

*Primary Examiner*—Thomas M. Sember
*Assistant Examiner*—Jacob Y. Choi
(74) *Attorney, Agent, or Firm*—McDonnell Boehnen Hulbert & Berghoff LLP

(57) ABSTRACT

A tubular reflector for reflecting light emanating from a tubular light source. The tubular reflector may be semi-circular or elliptical in shape and positioned around the tubular light source. Furthermore, the inner reflective surface of the tubular reflector may be smooth or multi-faceted. The reflector may reflect light from the tubular light source and redirect the light to achieve a desired distribution pattern.

18 Claims, 5 Drawing Sheets

REFLECTOR APPARATUS FOR A TUBULAR LIGHT SOURCE

BACKGROUND

1. Field of Invention

The present invention relates to the field of tubular reflecting. More particularly, the present invention relates to a tubular reflector and a tubular lighting device for automotive lighting.

2. Background of the Invention

There is generally an increasing need, particularly in the automotive lighting industry, for tubular light source applications. For example, one such application may be to a Center High Mount Stop Lamp (i.e., CHMSL). Tubular light sources used in such applications may be mounted within an elongated reflector having a parabolically shaped reflecting surface. For example, FIG. 1 illustrates a tubular lighting device 5 having a height y and having a tubular light source 10 situated within a parabolic reflector 20. The reflector 20 has a first aperture end 26 and a second aperture end 28, the distance between the two ends 26, 28 (i.e., distance y) defines a reflector aperture 35.

Reflector 20 includes a parabolically shaped reflective surface 24 for reflecting rays emitted from source 10. Surface 24 extends from the first reflector end 26 internally within reflector 20 to the second reflector end 28.

Generally, the light source 10 is disposed near a focal point, f, of the parabolic reflector 20. In this manner, light emanating from light source 10 is distributed away from source 10 and towards reflecting surface 24. Light incident upon reflecting surface 24 is reflected and directed forward towards aperture 35, parallel to a paraboloid axis of reflector 20, axis-a. Aperture 35 may include a lens 36 through which the reflected light is then transmitted. For example, the lens may or may not have pillow or fluting optics. These optics may serve to provide additional spread if necessary, depending upon the desired beam pattern. The lens optics may also serve to provide certain aesthetic characteristics of the reflector, such as providing a more uniform appearance.

For example, light ray 14' emitted from source 10 is directed towards the reflective surface 24 of reflector 20. Ray 14' is incident upon surface 24 at point R1 and ray 14" is redirected towards aperture 35 parallel to axis-a. In a similar manner, emitted ray 16' is directed towards reflector surface 24. Ray 16' is incident at point R2 and ray 16" is redirected towards aperture 35, parallel along axis a. At aperture 35, rays 14", 16" may be refracted by a prism or lenses of the lens 36. In this manner, reflector 20 may be used in conjunction with a lens device to form a lighting device, forming a desired beam pattern.

One disadvantage of tubular lighting devices, such as device 5, is that, because of the location of the light source, the amount of controlled light (i.e., light directed to the aperture) may not be optimized because of the location of the light source. Consequently, the overall illumination efficiency of the lighting device may be adversely affected. One reason that efficiency may be adversely affected is that a reflector has a relatively large height in comparison to the depth of the reflector. So, the amount of light that may be collected by the reflector and that forms the desired beam pattern is small. For example, as shown in FIG. 1, $\alpha_1$ represents an upper half amount of light emanated from source 10 and reflected towards aperture 35. Reduced efficiency and therefore a smaller $\alpha_1$ may be caused in part by emanated light that is not redirected towards lens 36 and therefore does not contribute to the overall efficiency.

For tubular reflectors having relatively small apertures, light emanating from a light source, reflected by the reflector, and hence directed towards the reflector aperture is limited. Since certain tubular reflector applications require a small aperture, such as the aperture in an automotive CHMSL application, emanated light may not be reflected and/or directed towards the aperture. Consequently, a portion of the overall illuminated light does not enhance the overall efficiency of the reflector, and therefore the efficiency of overall lighting device.

Another general disadvantage of parabolic reflectors, such as reflector 20 shown in FIG. 1, is the restricted height of a tubular light source 10. Typically, in certain automotive lighting device applications, such light sources may range in height (diameter) from 3 mm to 10 mm. The light source height may be limited by design constraints imposed by certain applications, particularly automotive lighting design constraints.

The reduction of the overall height for styling and mounting requirements may also result in limiting reflector efficiency. To a certain degree, the reduced height may be offset by increased depth, but only with diminishing effects on the light efficiency. For example, where the light source is mounted in an automobile spoiler, a limiting design constraint may be the overall dimensions of the spoiler. Usually, a limiting constraint is the neon tube system. While it may be possible to use a neon tube having the length of a spoiler, using a tube having such a length may be impractical due to certain power considerations.

There is, therefore, a general need for a tubular light source and a tubular reflector that increases the collection of emanated light such that an increased amount of reflected light may be directed towards the reflector aperture. There is also a general need to increase the amount of reflected light, direct this collected light in a desired beam pattern while also increasing styling flexibility. A need also exists for a reflector configuration that increases the collected and emanated light while also attempting to limit the overall height of the tubular reflector.

A need also exists such that a resulting illumination distribution pattern may satisfy certain automotive illumination requirements, such as a Federal Motor Vehicle Safety Standards 571.108 ("FMVSS"). FMVSS which is herein entirely incorporated by reference and to which the reader is directed to for further information.

Alternatively, there is a general need for a reflector configuration that increases the collected and emanated light such that a resulting illumination distribution pattern may satisfy certain lighting standards imposed by automotive manufacture, such as Ford, General Motors, Honda or the like.

SUMMARY OF THE INVENTION

In accordance with the invention, a tubular reflector includes a reflector portion generally positioned about a tubular light source. The reflector portion reflects light emanating from the light source. A semi-circular reflector having a generally smooth reflective surface is coupled to the reflector portion so that light emanating from the tubular light source is reflected off of the semi-circular reflector and towards the aperture of the tubular reflector.

In accordance with another aspect of the invention, a tubular reflector includes a semi-circular reflector for positioning about a tubular light source. The semi-circular reflector reflects light emanating from the tubular light source. A multi-faceted reflector is coupled to the semi-circular reflector. The reflective surface has at least two facets positioned at angles to one another so that light emanating from the tubular light source is reflected from the light source.

In yet another aspect of the invention, a tubular lighting device includes a housing portion having an interior reflecting surface. A first reflective finish is disposed on the interior reflecting surface. A reflector portion is coupled to the interior reflecting surface. A tubular light source is mounted in the semi-circular reflector portion. A second reflective finish is disposed on the semi-circular reflector portions. A lens portion is coupled to the housing portion such that the finish reflects light from said tubular light source towards the lens portion.

DETAILED DESCRIPTION

Figure 2:
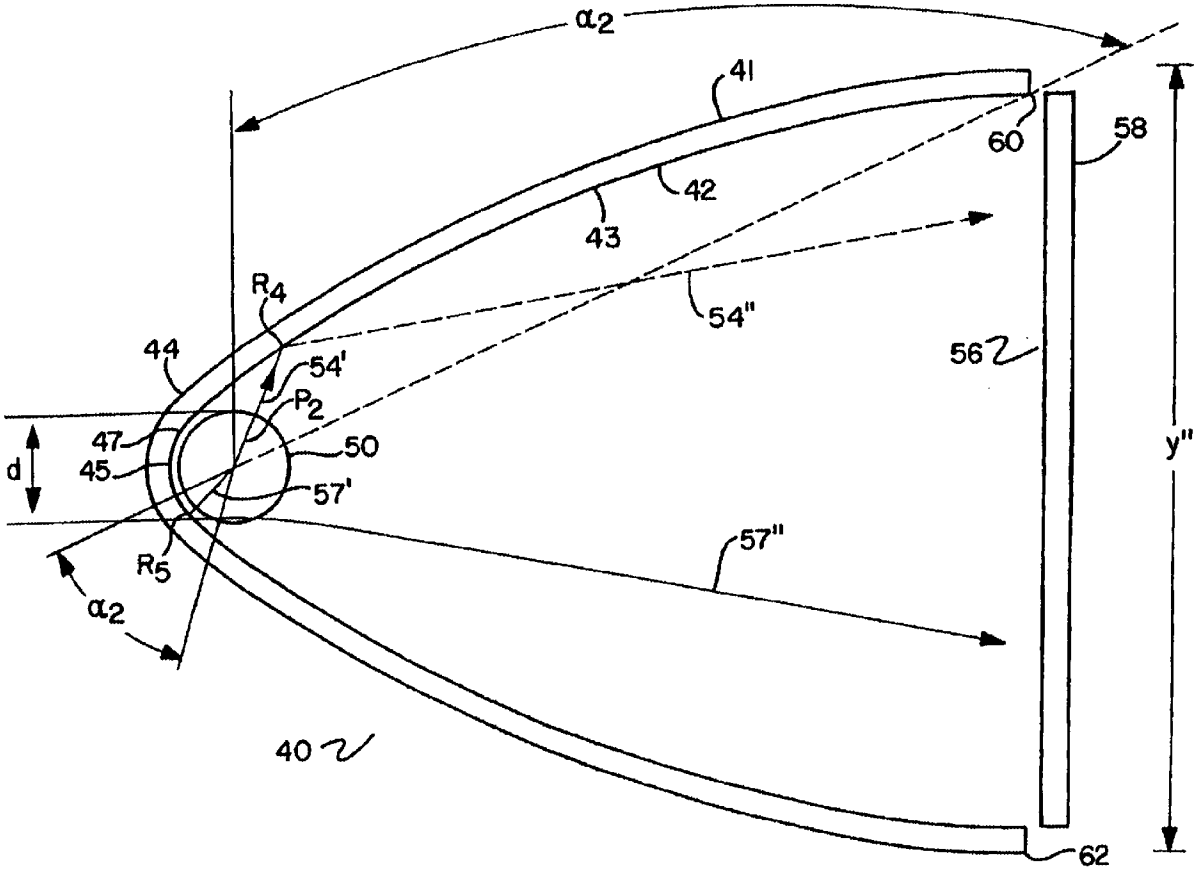
FIG. 2 illustrates a cross sectional view of a reflector incorporating a preferred embodiment of the present invention and including a reflector positioned about a tubular light source.

FIG. 2 illustrates a cross sectional view of a tubular lighting reflector 40 incorporating a preferred embodiment of the present invention. Lighting device 40 includes a reflector 41 having a generally smooth internally reflective surface 42 extending from a first surface end 60 of the reflector 41 to a second surface end 62 of the reflector 41. The distance between the surface ends 60, 62 defines a reflector aperture 56. In the exemplary embodiment illustrated in FIG. 2, the height of the aperture is represented by y." Preferably, surface 42 includes a reflective finish 43 such as aluminum metalization. Other reflective finishes such as argent paint or chrome coating may also be used.

Reflector 40 also includes a reflector portion 44 having a reflective surface 45. A tubular light producing element 50 is positioned within the reflector portion 44. Preferably, reflector portion 44 is a semi-circular reflector and reflective surface 45 includes a reflective finish 47 similar to the finish provided on reflective surface 42.

Reflector portion 44 has a generally circular shape. Alternatively, the reflector 44 may be slightly elliptical. Reflector portion 44 is positioned about tubular light producing element 50 which acts as a volume emitter. Reflector portion 44 has a height generally equivalent to the diameter of light source 50. In this exemplary embodiment, this diameter is illustrated as the distance d in FIG. 2. The light source can be clipped in place. Other mounting methods, such as trapping, may also be utilized.

For purposes of this general discussion, light emanating from light element 50 may be said to emanate from a center of the volume emitter 50, such as from light point P2. For example, light ray 54' can be said to emanate from light source 50 (i.e., light point P2). Ray 54' will be incident upon surface 42 and reflect at reflecting point R4. Reflective surface 42 redirects ray 54" towards a reflector aperture 56. A lens means 58, for example a pillow or flute optic, may be coupled to reflector 41. In such an embodiment, at aperture 56, redirected light ray 54" may propagate through a lens means 58 so that the redirected light may be processed to achieve a desired beam pattern. The lens may be mounted with glue or welded to the reflector 41.

Reflector portion 44 of reflector 40 provides a means for increasing the amount of redirected light. Since the embodiment illustrated in FIG. 2 provides a means of increasing the quantity of light directed towards aperture 57, the overall ratio of redirected versus emitted light is increased (i.e., the reflector efficiency increases). For example, ray 57' emanating from point P2 may be directed towards reflector surface 47 of reflector portion 44. Ray 57', incident at R5 of surface 47, is reflected back through light providing element 50 and consequently there is no scattering. Ray 57" will then act as if it were emitted from P2 in the opposite direction.

Figure 1:
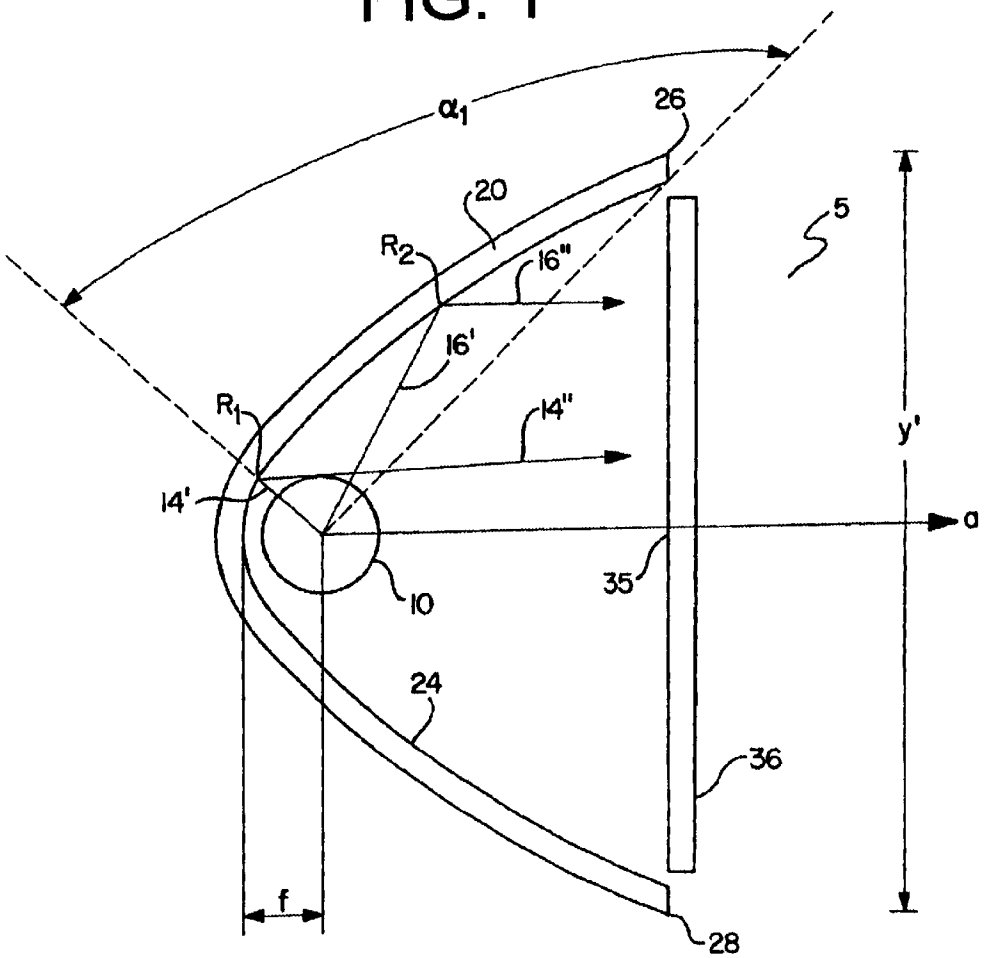
FIG. 1 illustrates a cross sectional view of a parabolic lighting device including a parabolic reflector and a tubular light source.

Several advantages are achieved by positioning light source 50 within the reflector portion 44 of a semi-circular or generally elliptical reflector. One advantage is that the amount of light re-directed towards lens means 58 is increased. Consequently, the overall reflector efficiency of the reflector 40 may be increased. This may be evidenced by comparing $\alpha_2$ of FIG. 2 which is generally twice the size of $\alpha_1$ of FIG. 1.

In an alternative preferred embodiment, an inner reflective surface of a tubular reflector is multi-faceted. In such a preferred embodiment, a plurality of facets are arranged in a step-wise orientation so that the reflected and hence redirected light achieves a desired distribution pattern. Such a preferred configuration may also maximize light source distribution efficiency. Alternatively, various multi-faceted reflector embodiments may be configured so as to comply with specific lighting distribution requirements, such as the FMSSV. Such reflectors may be coupled to a lens means such that the body and lens means comprise an automotive lighting device, such as a CHMSL, a stoplamp, or the like.

Figure 3:
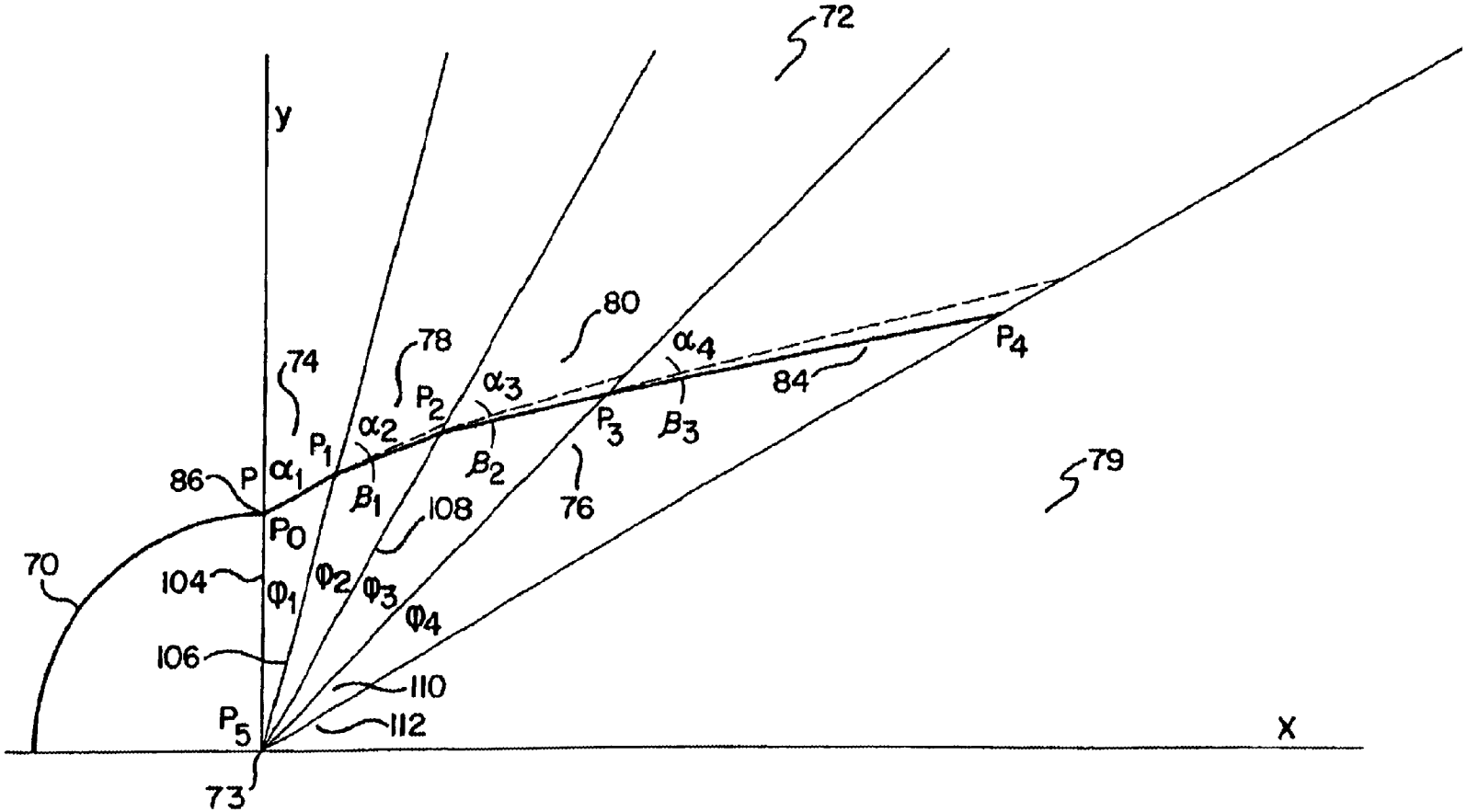
FIG. 3 illustrates a partial view of a tubular reflector incorporating a preferred embodiment of the present invention and including a reflection diagram for the tubular light producing element shown in FIG. 2.

FIG. 3 illustrates a partial view of a preferred multi-faceted tubular reflector 72. FIG. 3 includes a partial view of a semi-circle reflector portion 70 having a radius b. In the exemplary embodiment illustrated in FIG. 3, reflector 72 has four reflecting facets 74, 78, 80, and 84. Each facet has an inner reflective surface 76. Preferably, the reflecting surfaces of the facets have similar reflective finishes. For ease of discussion, semi-circular reflector 70 and multi-faceted reflector 72 are positioned along an x versus y graph.

FIG. 3 includes a ray diagram for a tubular light producing element 73 (i.e., P5). By computing the various angles shown in FIG. 3, the facet location and angle positioning between each adjacent facet may be derived.

In one aspect of the present invention, facet location and angle are chosen such that the configured multi-faceted reflector creates a light distribution pattern that complies with certain light distribution requirements. For example, location and angle of facet orientation may be chosen such that the resulting light distribution pattern meets requirements of FMVSS.

In FIG. 3, various light rays are shown emanating from light source point P5. Rays 106, 108, 110 and 112 emanate from point P5 at various angles. For example, ray 106 emanates from an angle of $\phi_1$ from the vertical 104 (i.e., y-axis). Emanated rays are then incident upon reflective surface 76 of reflector 72.

The geometry of the reflector 72 includes a plurality of facets: a first facet 74, a second facet 78, a third facet 80, and a fourth facet 84. These facets reflect light emanating from light source 74 at several different angles towards, preferably away from the reflector portion 70. The reflected or redirected light is then directed towards an aperture 79 and preferably onto a target surface, which may be a lens. The multi-faceted reflector has the effect of redirecting the reflected light and therefore may provide a desired distribution of light towards aperture.

In a preferred embodiment, facet location may be altered in order for the resulting reflector to achieve a desired light distribution pattern. For example, facet orientations may be derived so as to generate a certain light distribution pattern as called for a Federal regulation or alternatively as called for by an automobile manufacture. Below, the following equations provide one method to determine facet location for a tubular reflector CHMSL application wherein the above and below horizontal angular differential is 15°. For the equations provided below, it is assumed that $\phi 1$, $\phi 2$ etc. are equivalent.

Referring to FIG. 3, one can derive the following equations given three points (P1, P2, and P3) in two-dimensional space. Point P1 defines the end of first facet 74 and the start of second facet 78 and point P2 defines the end of second facet 78 and the start of third facet 80. Similarly, third point P3 defines the end of third facet 80 and the start of fourth facet 84. Point P4 defines and end point of reflector 72 and the aperture of the reflector.

In the following equations, assuming that the tubular light source has a radius of b, one can determine the location in two dimensional space of two points: $P_1=(x_1, y_1)$ and $P_2=(x_2, y_2)$ so as the locations of the first facet 74 may be determined. A similar determination can then be made for the second, third, and fourth facets 78, 80, and 84 respectively.

The start of the first facet 74 is given as $P_0=(x_0, y_0)=(0, b)$. For the termination of facet 74 and therefore the start of facet 78 (i.e., point $P_1=(x_1, y_1)$), one can solve as follows:

$$y_1 = \tan\left(\frac{\pi}{2} - \varphi_1\right)x_1 = \cot(\varphi_1)x_1$$

$$y_1 - b = \tan\left(\frac{\pi}{2} - \alpha_1\right)x_1 = \cot(\alpha_1)x_1$$

$$x_1(\cot(\varphi_1) - \cot(\alpha_1)) = b$$

$$x_1\left(\frac{\sin(\alpha_1 - \varphi_1)}{\sin(\alpha_1)\sin(\varphi_1)}\right) = b$$

$$x_1\left(\frac{\sin(\alpha_2)}{\sin(\alpha_1)\sin(\varphi_1)}\right) = b$$

Therefore, the location of the start of the second facet 78 (i.e., P1) can be derived as follows:

$$x_1 = \left(\frac{\sin(\alpha_1)\sin(\varphi_1)}{\sin(\alpha_2)}\right)b$$

$$y_1 = \frac{x_1}{\tan(\varphi_1)}$$

For an exemplary embodiment, $\alpha_1=52.5°$, $\alpha_2=37.5°$, $\phi_1=15°$, and b=5. Applying the above equations, one may derive the following: $x_1=1.69$, and $y_1=6.29$.

For the location of the end of the second facet 78 and the start of the third facet (i.e., location of the second point $P_2(x_2, y_2)$), assuming that $\phi_1=\phi_2$, one may derive the following:

$$y_2 = \cot(\varphi_1 + \varphi_2)x_2$$

$$y_2 = \frac{x_2}{\tan(2\varphi_1)}$$

$$\begin{aligned}\frac{y_2 - y_1}{x_2 - x_1} &= \tan\left(\frac{\pi}{2} - (\varphi_1 + \alpha_2 + \beta_1)\right)\\ &= \cot(\varphi_1 + \alpha_2 + \beta_1)\\ &= \cot(\varphi_1 + \alpha_1 - \varphi_1 + \beta_1)\\ &= \cot(\alpha_1 + \beta_1)\end{aligned}$$

$$y_2 - y_1 = \cot(\alpha_1 + \beta_1)(x_2 - x_1)$$

$$x_2[\cot(2\varphi_1) - \cot(\alpha_1 + \beta_1)] = y_1 - \cot(\alpha_1 + \beta_1)x_1$$

$$x_2\left(\frac{\sin(\alpha_1 + \beta_1 - 2\varphi_1)}{\sin(\alpha_1 + \beta_1)\sin(2\varphi_1)}\right) = y_1 - \left(\frac{x_1}{\tan(\alpha_1 + \beta_1)}\right)$$

$$x_2\left(\frac{\sin(\alpha_3)}{\sin(\alpha_1 + \beta_1)\sin(2\varphi_1)}\right) = y_1 - \left(\frac{x_1}{\tan(\alpha_1 + \beta_1)}\right)$$

Therefore, for P2 one may solve as follows:

$$x_2 = \left(y_1 - \frac{x_1}{\tan(\alpha_1 + \beta_1)}\right)\left(\frac{\sin(\alpha_1 + \beta_1)\sin(2\varphi_1)}{\sin(\alpha_3)}\right)$$

$$y_2 = \left(\frac{x_2}{\tan(2\varphi_1)}\right)$$

And for P3 one may solve:

$$y_3 = \cot(3\varphi_1)x_3$$

$$\begin{aligned}\frac{y_3 - y_2}{x_3 - x_2} &= \cot(\alpha_3 + \beta_2 + 2\varphi_1)\\ &= \cot(\alpha_1 + \beta_1 - 2\varphi_1 + \beta_2 + 2\varphi_1)\\ &= \cot(\alpha_1 + 2\beta_1)\end{aligned}$$

$$y_3 - y_2 = \cot(\alpha_1 + 2\beta_1)(x_3 - x_2)$$

$$x_3[\cot(3\varphi_1) - \cot(\alpha_1 + 2\beta_1)] = y_2 - \left(\frac{x_2}{\tan(\alpha_1 + 2\beta_1)}\right)$$

Therefore, for the third point P3, one may conclude:

$$x_3 = \left(y_2 - \frac{x_2}{\tan(\alpha_1 + 2\beta_1)}\right)\frac{\sin(\alpha_1 + 2\beta_1)\sin(3\varphi_1)}{\sin(\alpha_4)}$$

$$y_3 = \frac{x_3}{\tan(3\varphi_1)}$$

Consequently, based on the above resulting three equations, the three unknowns $x_i$, $y_i$, and $\alpha_i$ may be solved:

$$x_i = \left(y_{i-1} - \frac{x_{i-1}}{\tan(\alpha_1 + (i-1)\beta)}\right)\frac{\sin(\alpha_1 + (i-1)\beta)\sin(i\varphi_1)}{\sin(\alpha_{i+1})}$$

$$y_i = \frac{x_i}{\tan(i\varphi_1)}$$

Furthermore, by making a number of assumptions, generally equations may be derived for the $_i^{th}$ and $k_i^{th}$ facet of a multi-faceted reflector:

$$\varphi_1 = \varphi_2 = \ldots = \varphi$$

$$\beta_1 = \beta_2 = \ldots = \beta$$

-continued $$\alpha_2 = \alpha_1 - \varphi$$

$$\alpha_3 = (\alpha_2 + \beta) - \varphi = \alpha_1 + \beta - 2\varphi$$

$$\alpha_4 = (\alpha_3 + \beta) - \varphi = \alpha_1 + 2\beta - 3\varphi$$

Therefore, for the $_i^{th}$ facet, once can derive the following:

$$\alpha_i = \alpha_1 - (i-2)\beta - (i-1)\phi \text{ for } i \geqq 2$$

Also $$\alpha_1 = \frac{\pi/2 + \varphi}{2} \quad \beta = \frac{\varphi}{2}$$

The following equations provide a means for determining the orientation of the facets of a multi-faceted reflector having a semi-circular reflector portion. Alternatively, the multi-faceted reflector may have a semi-elliptical portion.

In the equations provided below, the first point P1 is designated in two dimensional space as $(x_1, y_1)$ and the second point P2 is designated in two dimensional space as $(x_2, y_2)$. Preferably, as illustrated in FIG. 3, P1 may be defined as the location of the beginning of the second facet and P2 may be defined as the location of the beginning of the third facet. Once the angle $\phi$ is chosen, $\beta$ may be derived and each facet location $(x_1, y_1)$ may be obtained from the above equations.

Figure 4:
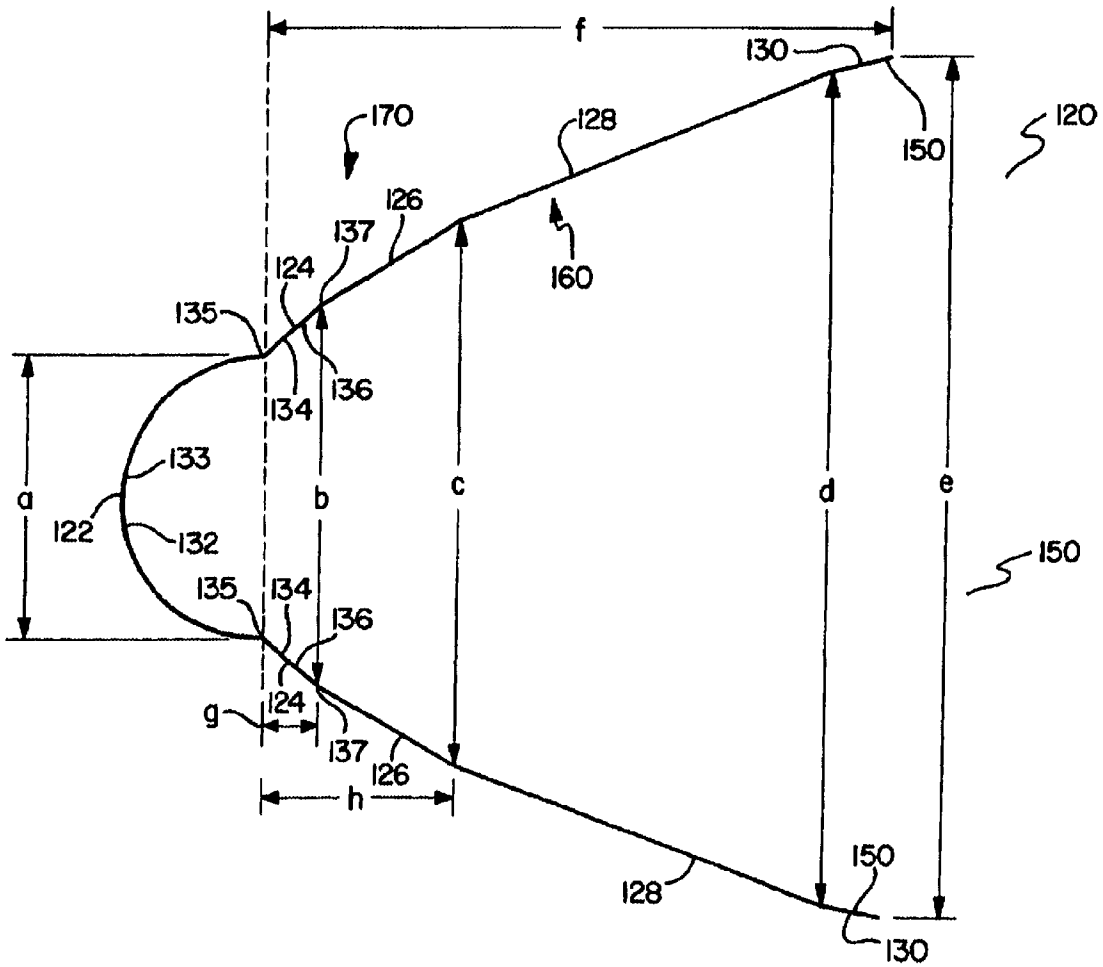
FIG. 4 illustrates a cross sectional view of a multi-faceted tubular reflector having a semi-circular reflector that may be positioned about a tubular light producing element.

FIG. 4 illustrates a cross sectional view of an exemplary embodiment of a multi-faceted tubular reflector 120 constructed in part, on the equations provided above. Reflector 120 includes a housing 170 having reflective surface 160 and a first reflector portion 122 having a reflective surface 132. A reflective finish 133 is disposed on reflective surface 132. Preferably, the first reflector portion 122 is semi-circular in shape. Alternatively, the first reflector portion 122 may be generally elliptical.

In FIG. 4, reflector portion 122 is positioned about a tubular light source (not shown). Reflector portion 122 has a diameter a and diameter a is generally equivalent to the diameter of the light source. In the embodiment illustrated in FIG. 4, diameter a of reflector 120 is 5.00 mm and the overall length of reflector 120 is 13.63 mm.

A light source (not shown in FIG. 4) is positioned within reflector portion 122. Reflector portion 122 is coupled to the reflecting surface 160. Surface 160 comprises various facets, 124, 126, 128, and 130. These facets are configured in a step-wise configuration so that emitted light is reflected off of the internal reflective surfaces of facets 124, 126, 128, and 130 towards reflector aperture 150. Reflector 120 preferably has an aperture of 15.00 mm.

In the embodiment illustrated in FIG. 4, reflector portion 122 is coupled to a first end 135 of first facet 124 of reflecting surface 160. First facet 124 has a reflective surface 134. Surface 134 has a reflective finish 136. Preferably, reflective finish 136 is of a similar type as reflective finish 133. In a preferred embodiment, facets have a common reflective finish.

The embodiment of the present invention illustrated in FIG. 4 includes four facets. However, it will be appreciated that first reflective surface may include less or more than the four facets illustrated in FIG. 4. The number of facets and/or facet configuration may be a function of the efficiency and/or the light distribution requirements of the reflector. The number of facets may also be a function of the particular geometry of the resulting lighting device. Overall length of reflector 120 including the depth of reflector portion 122 is 13.13 mm. The overall length of the multiple facet portion of reflector 120 is denoted as measurement f and is preferably 11.13 mm.

First facet 124 has a first end 135 and a second end 137. First end 135 is coupled to reflector portion 122. End portion 137 of first facet 124 extends away from reflector 10 portion 122, towards reflector aperture 150. Reflector aperture 150, designated by measurement e, is preferably 15.00 mm.

Second end of first facet 124 is coupled to a first end 137 of a second facet 126. Second facet 126 also has a second end extending towards aperture 150. The length of the first facet is given as measurement g and for reflector 120 is 1.10 mm. The diameter of second end is illustrated as measurement b and for reflector 120 is 6.69 mm. The diameter of the second end of second facet 126 is provided by measurement c and in this embodiment if 9.5 mm. The overall length of first facet 124 and second facet 126 is provided by the measurement h and for reflector 120 h is 3.45 mm.

Where the reflector illustrated in FIG. 4 is used for automotive lighting, the aperture could include a lens means, such as the lens shown and described previously with reference to FIG. 4. The lens may be pillowed or fluted to provide the required light distribution.

Similar to the configuration illustrated and previously described with reference to FIG. 2, a light source is positioned within reflector 122 which is, preferably a semi-circular reflector having a diameter of a. In the embodiment illustrated in FIG. 4, reflector 122 has a diameter a equal to 5.00 mm. Reflector portion 122 can, therefore, house light producing elements ranging in diameter from 3 mm and 10 mm.

Figure 5:
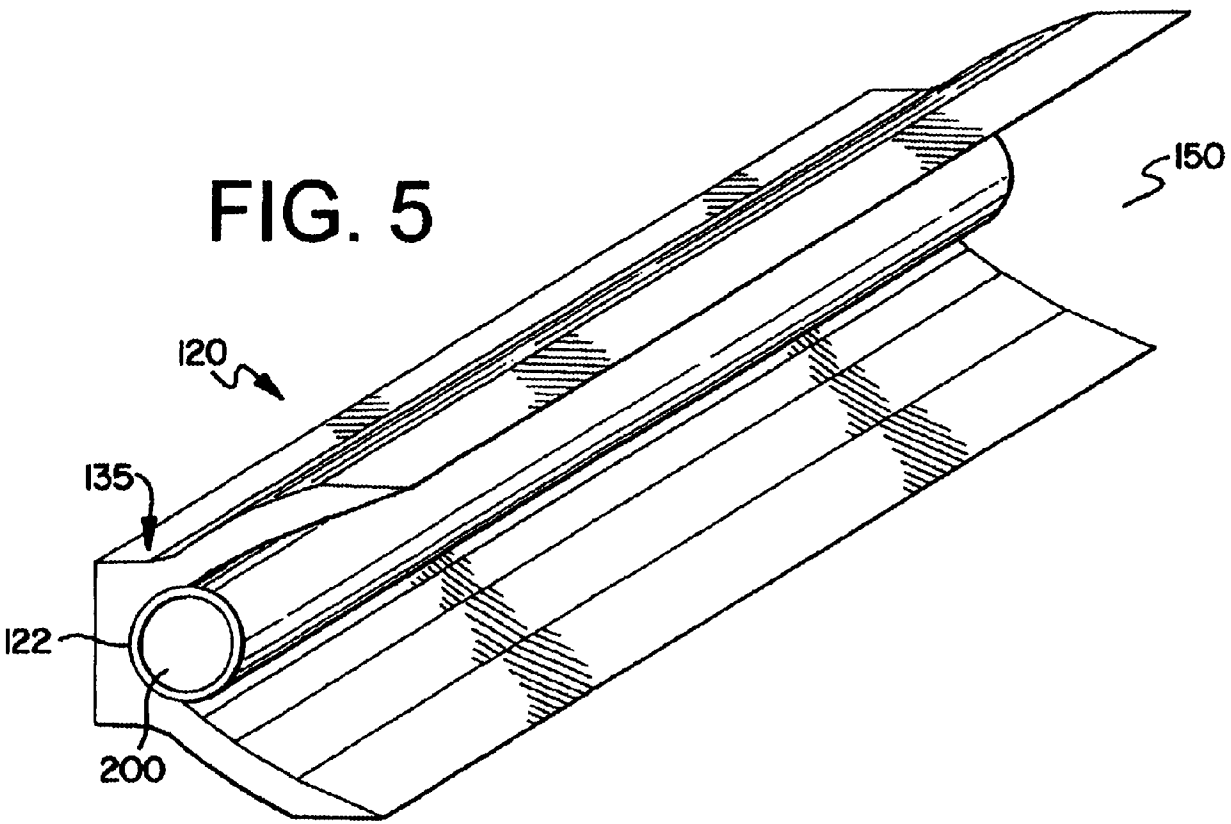
FIG. 5 illustrates a perspective view of the reflector in FIG. 4.

FIG. 5 illustrates a perspective view of the multi-faceted tubular reflector 120. FIG. 5 illustrates the reflector portion 122 positioned about a light producing element 200. As shown, the light producing element 200 is a neon tube. However, the light producing element 200 ma be any tubular, elongated, or linear light source.

While the invention has been described in conjunction with presently preferred embodiments of the invention, persons of skill in the art will appreciate that variations may be made without departure from the scope and spirit of the invention. This true scope and spirit is defined by the appended claims, as interpreted in light of the foregoing.

We claim:

1. An automotive tubular reflector comprising:

an automotive faceted elongated reflector extending from a first surface end to a second surface end, the automotive faceted elongated reflector positioned on both sides of an elongated tubular light source, the automotive faceted elongated reflector reflecting light emanating from the elongated tubular light source towards a rectangular aperture of the automotive tubular reflector; and an automotive elongated semi-circular reflector having a smooth reflective surface, the automotive elongated semi-circular reflector connected to the first surface end of the automotive faceted elongated reflector, wherein the elongated tubular light source is freely positioned within the automotive elongated semi-circular reflector so that light emanating from the elongated tubular light source is reflected off of the smooth reflective surface of the automotive elongated semi-circular reflector and re-directed to pass through the elongated tubular light source towards the rectangular aperture of the automotive tubular reflector.

2. The invention of claim 1 wherein the automotive faceted elongated reflector is a semi-elliptical reflector.

3. The invention of claim 1 further comprising a lens means coupled to the automotive faceted elongated reflector, the lens means processing the reflected light.

4. The invention of claim 1 further comprising several reflective surfaces disposed on the automotive faceted elongated reflector.

5. The invention of claim 1 further comprising a reflective finish disposed on the automotive elongated semi-circular reflector.

6. The invention of claim 5 wherein the reflective finish disposed on the automotive elongated semi-circular reflector is essentially the same as a reflective finish disposed on the automotive faceted elongated reflector.

7. An automotive elongated reflector comprising:

an automotive half-circle reflector having an elongated tubular light source freely positioned within the automotive half-circle reflector, the automotive half-circle reflector reflecting light emanating from the elongated tubular light source; and a multi-faceted reflector connected to the automotive half-circle reflector, the multi-faceted reflector having at least two facets positioned at angles to one another so that light emanating from the elongated tubular light source is reflected away from the elongated tubular light source and projected into an automotive signal lighting beam pattern.

8. The invention of claim 7 further comprising a lens means coupled to the multi-faceted reflector, the lens means receives and processes the reflected light.

9. The invention of claim 8 wherein a securing means for securing the multi-faceted reflector to the lens means is provided on the multi-faceted reflector.

10. The invention of claim 7 wherein the automotive elongated reflector is a vehicle stop lamp.

11. An automotive elongated lighting device comprising:

a housing portion having an interior reflecting surface that comprises a plurality of facets;

a first reflective finish disposed on the interior reflecting surface;

an automotive elongated semi-circular reflector portion connected to the interior reflecting surface;

an elongated tubular light source freely positioned in the automotive elongated semi-circular reflector portion, the automotive elongated semi-circular reflector portion formed around the elongated tubular light source so that light emanating from the elongated tubular light source is reflected off of the automotive elongated semi-circular reflector portion and re-directed to pass through the elongated tubular light source;

a second reflective finish disposed on the automotive elongated semi-circular reflector portion; and a lens portion coupled to the housing portion;

such that the first and second reflective finish reflects light from said elongated tubular light source towards the lens portion, and wherein each facet location and angle are chosen to create a light distribution pattern that complies with automotive signal lighting requirements.

12. The invention of claim 11 wherein the plurality of facets are arranged in a step-wise orientation.

13. The invention of claim 11 wherein each facet of the plurality of facets has a similar reflective finish.

14. The invention of claim 11 wherein the automotive elongated semi-circular reflector portion is semi-elliptical.

15. The invention of claim 7, wherein locations of the at least two facets are set according to points $x_i$ and $y_i$, and wherein $x_i$ and $y_i$ are determined according to:

$$x_i = \left(y_{i-1} - \frac{x_{i-1}}{\tan(\alpha_1 + (i-1)\beta)}\right)\frac{\sin(\alpha_1 + (i-1)\beta)\sin(i\varphi_1)}{\sin(\alpha_{i+1})} \text{ and}$$

$$y_i = \frac{x_i}{\tan(i\varphi_1)}$$

where $$\alpha_1 = \frac{\pi/2 + \varphi}{2}, \quad \beta = \frac{\varphi}{2},$$

and $\phi$ are chosen based on a desired length of the at least two facets, and wherein $\alpha$ and $\beta$ are outer and inner light distribution angles, and wherein i defines the number of facets where an ith facet is defined by points $x_i$ and $y_i$.

16. The invention of claim 11, wherein each facet location and angle are chosen to create the light distribution pattern that complies with automotive signal lighting requirements by setting desired outer and inner light distribution angles.

17. The invention of claim 16, wherein each facet location and angle are set according to points $x_i$ and $y_i$, and wherein $x_i$ and $y_i$ are determined according to:

$$x_i = \left(y_{i-1} - \frac{x_{i-1}}{\tan(\alpha_1 + (i-1)\beta)}\right)\frac{\sin(\alpha_1 + (i-1)\beta)\sin(i\varphi_1)}{\sin(\alpha_{i+1})} \text{ and}$$

$$y_i = \frac{x_i}{\tan(i\varphi_1)}$$

where $$\alpha_1 = \frac{\pi/2 + \varphi}{2}, \quad \beta = \frac{\varphi}{2},$$

and $\phi$ are chosen based on a desired length of the plurality of facets, and wherein $\alpha$ and $\beta$ are the outer and the inner light distribution angles, and wherein i defines the number of facets where an ith facet is defined by points $x_i$ and $y_i$.

18. The invention of claim 11, wherein the light distribution pattern that complies with automotive signal lighting requirements complies with the Federal Motor Vehicle Safety Standards 571.108 ("FMVSS 108").

* * * * *